US009153113B1

(12) United States Patent
Jones

(10) Patent No.: US 9,153,113 B1
(45) Date of Patent: Oct. 6, 2015

(54) OVEN DOOR SMOKE SENSOR

(71) Applicant: Diane C. Jones, Las Vegas, NV (US)

(72) Inventor: Diane C. Jones, Las Vegas, NV (US)

( * ) Notice: Subject to any disclaimer, the term of this patent is extended or adjusted under 35 U.S.C. 154(b) by 0 days.

(21) Appl. No.: 14/132,817

(22) Filed: Dec. 18, 2013

Related U.S. Application Data

(60) Provisional application No. 61/738,656, filed on Dec. 18, 2012.

(51) Int. Cl.
*G08B 17/10* (2006.01)

(52) U.S. Cl.
CPC ..... *G08B 17/10* (2013.01)

(58) Field of Classification Search
USPC ..... 340/628–631, 540, 577–579, 584, 340/691.1, 692; 379/42, 43; 200/61.03
See application file for complete search history.

(56) References Cited

U.S. PATENT DOCUMENTS

| | | | | |
|---|---|---|---|---|
| 4,160,246 | A | 7/1979 | Martin et al. | |
| 4,363,031 | A | 12/1982 | Reinowitz | |
| 4,496,817 | A | 1/1985 | Smith | |
| 5,493,119 | A | 2/1996 | Törngren | |
| 5,670,947 | A * | 9/1997 | Nagashima | 340/628 |
| 5,786,767 | A * | 7/1998 | Severino | 340/628 |
| 6,545,608 | B1 * | 4/2003 | Kaufman | 340/577 |
| 6,690,288 | B1 * | 2/2004 | Waddell | 340/692 |
| 6,788,211 | B2 | 9/2004 | Kouznetsov et al. | |
| 7,733,234 | B2 * | 6/2010 | Montgomery | 340/628 |
| 7,898,427 | B1 | 3/2011 | Kim | |
| 8,742,938 | B2 * | 6/2014 | Casey | 340/628 |
| 8,847,772 | B2 * | 9/2014 | Marks et al. | 340/628 |
| 2009/0212961 | A1 * | 8/2009 | McGivern | 340/628 |
| 2010/0073174 | A1 | 3/2010 | Dufour | |
| 2012/0043440 | A1 * | 2/2012 | Wilkowske | 248/216.4 |
| 2012/0180776 | A1 * | 7/2012 | Newsom et al. | 126/197 |
| 2014/0055261 | A1 * | 2/2014 | Su | 340/532 |
| 2014/0120219 | A1 * | 5/2014 | Ewell et al. | 426/231 |

OTHER PUBLICATIONS

Covert Digital Wireless Smoke Detector Security Camera. http://www.spycentre.com/Covert-Digital-Wireless-Smoke-Detector-Security-Camera.

* cited by examiner

*Primary Examiner* — Travis Hunnings
(74) *Attorney, Agent, or Firm* — Robert C. Montgomery; Montgomery Patent & Design, LP

(57) ABSTRACT

A smoke alarm system specifically designed to detect smoke near a kitchen stove includes a transmitter assembly having a smoke detection device housed within an enclosure which hangs upon an oven door handle or other such appendage. The transmitter assembly further comprises a transmitter module that generates a wireless signal upon detection of smoke and transmits the signal to a remote receiver. When activated by the signal from the transmitter assembly, the receiver assembly produces sound and illumination type alarms, thereby warning occupants of smoke that is emanating from the stove, and the need to take immediate corrective action.

7 Claims, 3 Drawing Sheets

OVEN DOOR SMOKE SENSOR

RELATED APPLICATIONS

The present invention was first described in and claims the benefit of U.S. Provisional Application No. 61/738,656, filed Dec. 18, 2012, the entire disclosures of which are incorporated herein by reference.

FIELD OF THE INVENTION

The present invention relates a smoke alarm system specifically designed to detect smoke in or around the surrounding area of a kitchen stove/oven which includes a smoke detector housed within an enclosure that suspends from an oven door handle or other such appendage.

BACKGROUND OF THE INVENTION

As any home owner will attest, security is an area of primary concern. Due to the fact that people tend to place a high value on their property and personal safety, the marketplace has responded with a variety of products that are intended to protect one's life and property. Perhaps the most common of these products is the smoke alarm. While such devices work with smoke that is generated anywhere in a home, such smoke often originates in the kitchen from food cooking on, or in the stove. Many valuable seconds can be lost before such smoke is detected at smoke detectors located a distance away. By then, smoke has permeated throughout the kitchen, and may even develop into a full fire. Accordingly, there exists a need for a means by which smoke generated from cooking on a stove can be detected as soon as possible in order to avoid the problems as described above.

SUMMARY OF THE INVENTION

The disadvantages of the prior art are overcome by the present invention in providing a smoke alarm system specifically designed to detect smoke near a kitchen stove and/or oven which includes a smoke detector housed within an enclosure that hangs upon an oven door handle or other such appendage. The smoke detector further comprises a transmitter that generates a wireless signal upon detection of smoke and transmits the signal to a remote receiver located nearby. When activated, the receiver produces sound and illumination type alarms, thereby warning occupants of the presence of smoke, and the need to take immediate corrective action. The development of the present invention prevents the all too common occurrence of burned food, or kitchen fires that originate at a kitchen stove or oven, in a manner that is not only easy and effective, but much safer and quicker than remote smoke detectors.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTIVE KEY

Figure 1:
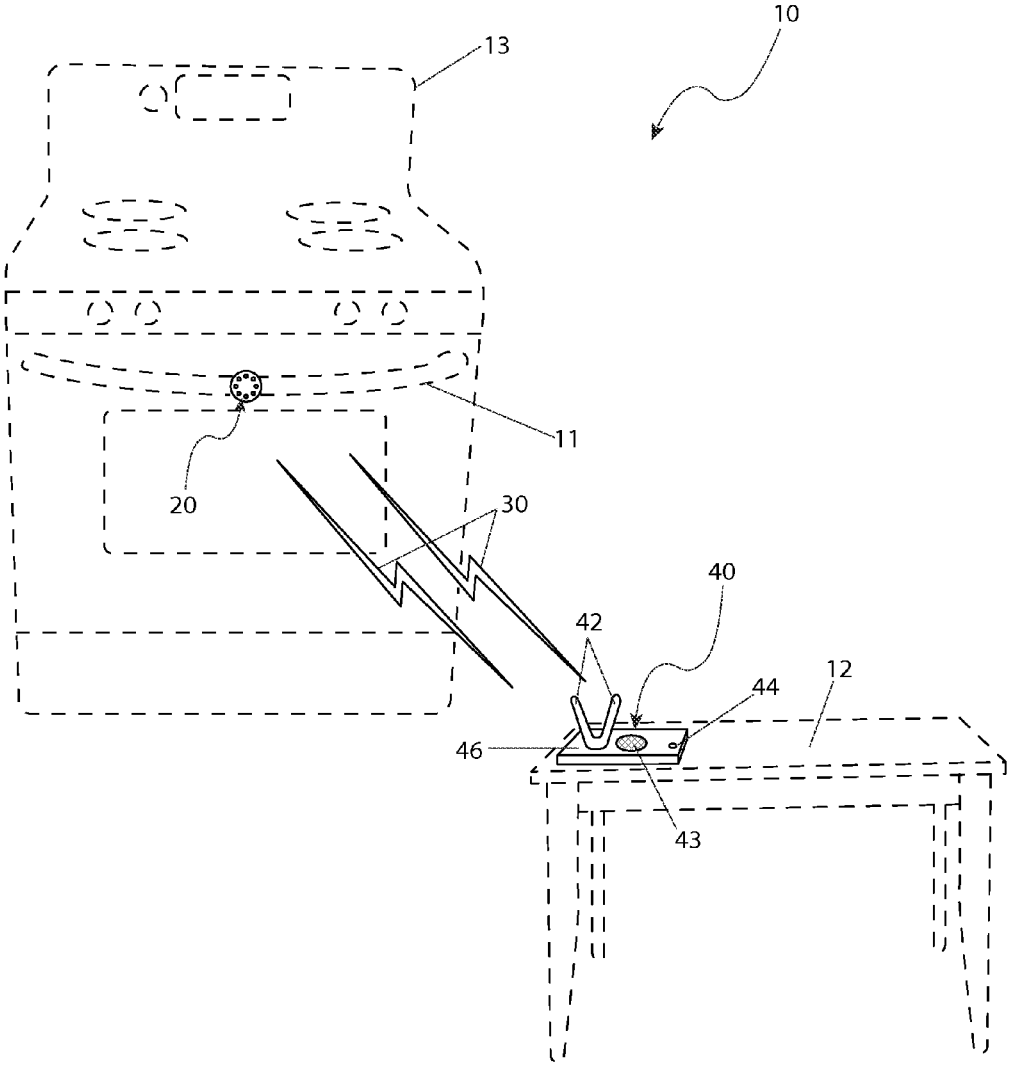
FIG. 1 is a front environmental view of a stove-mounted smoke alarm system 10, according to a preferred embodiment of the present invention.

10 stove-mounted smoke alarm system
11 oven handle
12 table
13 stove
20 transmitter assembly
21 battery
22 activation/reset switch
23 smoke detector
24 transmitter module
25 transmitter antenna
26 housing
27 transmitter hanger
28 vent aperture
30 signal
40 receiver assembly
41 AC power supply
42 receiver antenna
43 speaker
44 indicator lamp
45 receiver reset switch
46 receiver housing
47 receiver module

DETAILED DESCRIPTION OF THE PREFERRED EMBODIMENT

Figure 2:
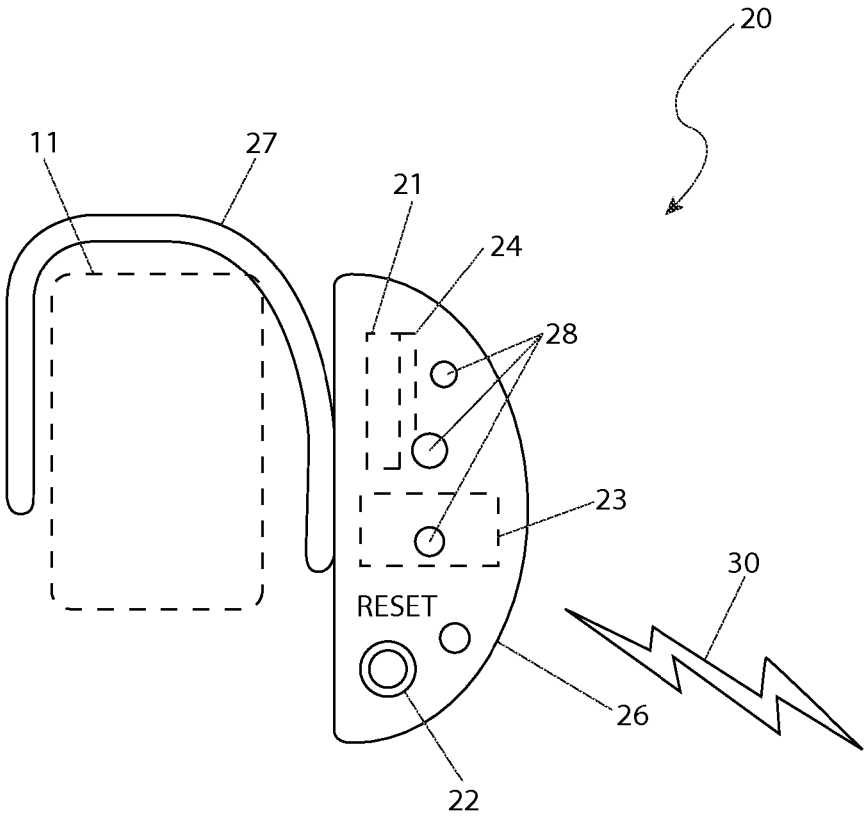
FIG. 2 is a side environmental view of a transmitter assembly portion 20 of the stove-mounted smoke alarm system 10 depicting attachment to an oven handle 11, according to a preferred embodiment of the present invention; and, FIG. 3 is an electrical block diagram of the stove-mounted smoke alarm system 10, according to a preferred embodiment of the present invention.
Figure 3:
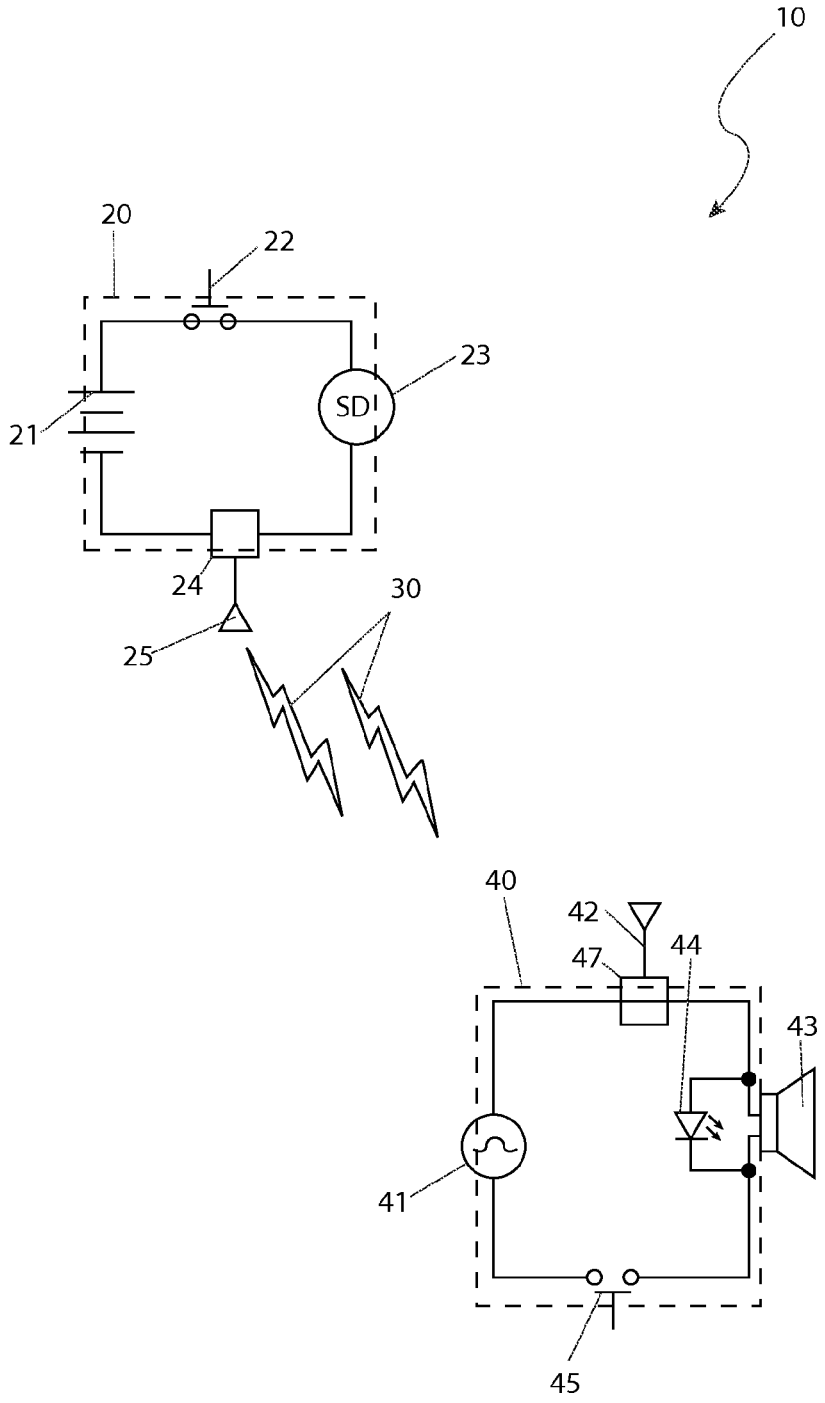

The best mode for carrying out the invention is presented in terms of its preferred embodiment, herein depicted within FIGS. 1 through 3. However, the invention is not limited to the specifically described embodiment. A person skilled in the art will appreciate that many other embodiments of the invention are possible without deviating from the basic concept of the invention. Any such work around will also fall under scope of this invention. While only one particular configuration is shown and described that is for purposes of clarity and disclosure and not by way of limitation of scope.

The present invention describes a smoke alarm system (herein described as the "system") 10, which provides a means for detecting excessive smoke being emitted from foodstuffs within a kitchen heating/cooking/baking device 13. It should be appreciated that any of a variety of known kitchen heating/cooking/baking devices are considered herein, but for simplicity will be referred to throughout as a "stove" 13.

Referring now to FIGS. 1 and 2, environmental views of the system 10, according to the preferred embodiment of the present invention, are disclosed. The system 10 comprises a transmitter assembly 20 and a receiver assembly 40. The transmitter assembly 20 includes a protective dome-shaped hollow plastic body or housing 26 and is preferably fastened to an oven handle portion 11 of the stove 13 or other suitable protruding member via a transmitter hanger 27. The transmitter hanger 27 includes an inverted "U"-shaped appendage being integral to a rear surface of the housing 26; however, it is understood that other methods of attaching the transmitter hanger 27 may be provided such as adhesives, magnets, locking devices or the like.

The protective transmitter housing 26 of the transmitter assembly 20 includes internal electrical and electronic portions. Within the transmitter housing 26, a power source provides the operative power for the transmitter assembly 20 and may take the form of a battery 21 as shown in the Figs. Also included within the transmitter housing 26 is a smoke detecting device 23, and a signal transmitter module 24. An external activation/reset switch 22 is provided for the on and off activation/deactivation of the transmitter assembly 20, the communication testing with the receiver assembly 40, and silencing of the system 10. If a smoke emitting event occurs, the smoke detecting device 23 within the transmitter assembly 20 detects the presence of the smoke as it passes from the ambient environment into the transmitter housing 20 through a plurality of equally-spaced external vent aperture portions 28 arranged in a circular pattern around the transmitter housing 26. The smoke detecting device 23 causes the transmitter module 24 to initiate the transmission of a wireless signal 30 to the remotely located receiver assembly 40.

The receiver assembly 40 receives the signal 30, and in turn generates audio and visual alarms to alert an occupant such as a cook, or other occupant, of smoke having been detected. The receiver assembly 40 provides a receiver housing 46 preferably being an aesthetic rectangular shape. It is envisioned that the receiver assembly 40 would be located in an area where the occupant is located, placed for example upon a flat surface such as upon a table 12 or other similar surface, to effectively alert the occupant. The transmitter assembly 20 and the receiver assembly 40 are envisioned to be introduced in various colors and patterns and fabricated from durable and heat resistant plastic and metal materials.

Referring now to FIG. 3, an electrical block diagram of the system 10, according to the preferred embodiment of the present invention, is disclosed. The transmitter assembly 20 comprises a battery 21, an activation/reset switch 22, a smoke detector 23, and a transmitter module 24. The battery 21 is envisioned to be a disposable or rechargeable user-replaceable battery which supplies current capable of starting, stopping, and resetting the electronic portions of the system 10. The activation/reset switch 22 is preferably a pushbutton-type switching device, yet other similar devices may be utilized without limiting the scope of the invention. The smoke detector 23 is mounted internally within the transmitter assembly 20 being aligned with the aforementioned vent apertures 28. The smoke detector 23 includes a conventional smoke detection element such as photoelectric, ionization, rate-of-rise, or similar element type, having corresponding smoke detection circuitry. The transmitter module 24 preferably generates a radio frequency (RF) type signal 30 upon detection of the smoke. The signal 30 is broadcast through a transmitter antenna 25, which may be of a type located fully within the transmitter housing 26 or may extend outwardly. The signal 30 is received by the remote receiver assembly 40 positioned at a desired location.

The receiver assembly 40 is enclosed within a receiver housing 46 and utilizes an AC power source 41 to provide power to a receiver module 47, a speaker 43, an indicator lamp 44, and a receiver reset switch 45. The AC power source 41 is envisioned to be a common 110-volt plug and power cord which utilizes a standard household electrical outlet. The receiver antenna 42 is preferably mounted upon a top surface of the receiver housing 46 along with the speaker 43 and the lamp 44. The receiver antenna 42 may be an external "rabbit-ears" type or internal type antenna. The receiver antenna 42 accepts the signal 30 from the transmitter module 24 and passes it to the receiver module 47 which in turn activates the speaker 43 to generate an audible alarm and also illuminates the indicator 44, thereby further alerting the occupant of a hazardous smoke situation in the vicinity of the stove 13. The indicator 44 is preferably a light-emitting diode (LED) type device or may utilize an equivalent current illumination technology. The receiver reset switch 45 is provided for the on and off activation/deactivation of the receiver assembly 40 and also provides a reset to the speaker 43 and indicator 44 following activation. The reset switch 45 is preferably a pushbutton-type switching device, yet other similar devices may be utilized without limiting the scope of the invention.

In operation, when the smoke detector 23 detects smoke in the vicinity of the stove 13, the transmitter module 24 transmits the signal 30. The receiver module 47 receives the signal 30 and utilizes the speaker 43 and indicator 44 to alert the occupant. It is envisioned that other styles and configurations of the present invention can be easily incorporated into the teachings of the present invention, and only one particular configuration shall be shown and described for purposes of clarity and disclosure and not by way of limitation of scope.

The preferred embodiment of the present invention can be utilized by the common user in a simple and effortless manner with little or no training. After initial purchase or acquisition of the system 10, it would be installed as indicated in FIGS. 1 and 2. The method of installing and utilizing the system 10 may be achieved by performing the following steps: acquiring the apparatus 10; installing a fresh battery 21 within the transmitter assembly 20; fastening the transmitter hanger portion 27 of the transmitter assembly 20 to a desired portion of the stove 13 such as an oven handle 11; placing the receiver assembly 40 at a desired location such as upon a table 12; activating the transmitter assembly 20 via the activation/reset switch 22; powering up the receiver assembly 40 by plugging into an AC power supply 41; activating the receiver assembly 40 by pressing the receiver/reset switch 45; performing a cooking task within the stove 13 in a normal manner; detecting smoke in an automatic manner via the smoke detector 23 and enabling the transmitter module 24 to transmit a wireless signal 30; enabling the receiver antenna 42 to receive the signal 30 and in turn alert a nearby occupant via audible and visual alarms from the respective speaker 43 and indicator 44; and, preventing and occurrence of burned food, or a possible kitchen fire originating from a kitchen stove 13, afforded a user of the present invention 10.

The foregoing descriptions of specific embodiments of the present invention have been presented for purposes of illustration and description. They are not intended to be exhaustive or to limit the invention and method of use to the precise forms disclosed. Obviously many modifications and variations are possible in light of the above teaching. The embodiment was chosen and described in order to best explain the principles of the invention and its practical application, and to thereby enable others skilled in the art to best utilize the invention and various embodiments with various modifications as are suited to the particular use contemplated. It is understood that various omissions or substitutions of equivalents are contemplated as circumstance may suggest or render expedient, but is intended to cover the application or implementation without departing from the spirit or scope of the claims of the present invention.

What is claimed is:

1. A smoke alarm system, comprising:

a transmitter assembly comprising:

a transmitter housing, said transmitter housing comprising a plurality vent apertures configured to allow air to directly enter said transmitter housing;

a smoke detection device disposed within said transmitter housing, said smoke detection device being configured to detect a presence of smoke entering said housing through said plurality of vent apertures;

a transmitter module disposed within said transmitter housing and in electrical communication with said smoke detection device, said transmitter module being configured to generate an RF output signal in response to detection of said smoke by said smoke detection device; and a handle coupled to and extending rearward from an exterior of said transmitter housing, said handle being removably attachable to a kitchen heating device; and a receiver assembly in wireless communication with said transmitter assembly, said receiver assembly comprising:

a receiver housing configured to lay horizontally upon a flat surface;

a receiver module disposed within said receiver housing, said receiver module being configured to receive said output signal from said transmitter module;

a speaker disposed within said receiver housing and in electrical communication with said receiver module, said speaker being configured to produce an audible warning output in response to reception of said output signal by said receiver module;

an indicator lamp disposed within said receiver housing and in electrical communication with said receiver module, said indicator lamp being configured to produce a visual warning output in response to reception of said output signal by said receiver module;

wherein said receiver assembly is disposed remotely from said transmitter assembly.

2. The system of claim 1, wherein said transmitter assembly further comprises:

a transmitter power source adapted to provide operating power to both said smoke detection device and said transmitter module.

3. The system of claim 1, wherein said transmitter assembly further comprises a transmitter antenna to broadcast said output signal to said receiver assembly.

4. The system of claim 1, wherein said transmitter assembly further comprises a switch adapted to provide for the activation, testing, and silencing of said system.

5. The system of claim 1, wherein said receiver assembly further comprises:

a receiver power source adapted to provide operating power to said speaker, said indicator lamp, and said transmitter module.

6. The system of claim 1, wherein said receiver assembly further comprises a receiver antenna to receive said output signal from said transmitter assembly.

7. The system of claim 1, wherein said receiver assembly further comprises a switch adapted to provide for the activation, testing, and silencing of said system.

* * * * *